United States Patent [19]

Nyffenegger

[11] 4,285,351

[45] Aug. 25, 1981

[54] MONITORING DEVICE FOR THE COIN CONTAINER OF A COIN COLLECTING MECHANISM

[75] Inventor: Alfred Nyffenegger, Uetendorf, Switzerland

[73] Assignee: Autelca AG, Gumligen, Switzerland

[21] Appl. No.: 50,154

[22] Filed: Jun. 20, 1979

[30] Foreign Application Priority Data

Jul. 12, 1978 [CH] Switzerland ..... 7577/78

[51] Int. Cl.[3] ..... G07D 9/00

[52] U.S. Cl. ..... 133/1 R; 194/1 F; 194/DIG. 15; 340/570; 340/612

[58] Field of Search ..... 133/1 R, 1 A; 194/1 B, 194/1 F, 1 C, 1 D, 1 R, DIG. 15; 340/568, 570, 612, 617

[56] References Cited

U.S. PATENT DOCUMENTS

| | | | |
|---|---|---|---|
| 2,642,881 | 6/1953 | Buchholz | 340/617 |
| 2,946,991 | 7/1960 | Lindenberg | 340/617 |
| 3,422,415 | 1/1969 | Ichimori | 340/617 X |
| 3,631,445 | 12/1971 | Shew | 340/570 X |
| 3,935,970 | 2/1976 | Spaw | 340/617 X |
| 4,124,775 | 11/1978 | Zarouni | 194/1 N |

*Primary Examiner*—Joseph J. Rolla

*Attorney, Agent, or Firm*—Brady, O'Boyle & Gates

[57] ABSTRACT

A contact pin extends into a removable metallic coin collecting container at a predetermined fill level and is connected to one end of the secondary winding of a transformer forming the tank circuit of a first oscillator which has an output signal circuit on the output thereof. The other end of the secondary winding is connected to the metallic coin container or to another contact pin spaced from the first contact pin a greater distance than the diameter of the coins being collected. When coins in the coin container reach the predetermined fill level they complete the contact pin circuit causing the output signal circuit to emit a signal indicative that the coin container is full. The wall of the removable coin container, when it is in place, extends through the field of an induction coil connected in the tank circuit of a second oscillator which has a second output signal circuit on the output thereof to emit a signal indicative of whether or not the coin container is in place.

11 Claims, 4 Drawing Figures

MONITORING DEVICE FOR THE COIN CONTAINER OF A COIN COLLECTING MECHANISM

BACKGROUND OF THE INVENTION

The invention relates to a monitoring device for the coin container of a cash collecting mechanism, for example of a prepayment telephone coin box or of a self-cash-collecting automatic ticket machine.

The purpose of the invention is to monitor electronically when the coin container is full in a simple, cheap and reliable manner, without the coin container, or the coins collected in it, communicating galvanically with the voltage source of the electronic monitoring device.

A direct galvanic connection, or one ensuing by way of the collected coins, of the metallic coin container with the voltage source is to be avoided because otherwise, for safety reasons, the coin container would have to be electrically insulated from the housing of the cash collecting mechanism.

SUMMARY OF THE INVENTION

Into the upper part of the coin container of a cash collecting mechanism there projects a contact pin which is connected to one end of a transformer winding, the other end of which is connected to the coin container. The other winding of the transformer forms the inductance circuit of an oscillator, which is connected to a circuit which emits a signal which indicates the presence of or suspension of oscillations from the oscillator. At a specific filling height or level of the coin container the coins collected in the container connect the contact pin to the container, by completing the circuit therebetween, whereby the oscillator oscillations are suspended.

Preferably, the contact means, such as the contact pin, is coupled inductively, such as by means of a transformer to the oscillator. This has the advantage that an adequate attenuation of the oscillator oscillations can even be achieved when the coins which connect the contact means in circuit with the coin container are severely contaminated and therefore form a very large ohmic resistance. The transformation ratio of the transformer is, in this respect, to be selected to be so great that the greatest possible resistance formed by severely contaminated coins is transformed to such a small resistance that the transformed resistance brings about an attenuation or damping of the oscillator which is adequate for suspending the vibrations or oscillations.

In the case of an exchangeable metallic coin container, the monitoring device of the invention also has a second oscillator and a second signal circuit. The coin container when correctly inserted into the cash collecting mechanism influences the field of the oscillator coil in such a way that the oscillator oscillations are suspended. The monitoring, thereby achieved, of the presence of a correctly inserted coin container is intended to prevent thefts by operators which would be easily possible as a result of non-insertion or incorrect insertion of the coin container on the cash or coin collecting mechanism. When this arrangement is used, the coins collected in the coin container are not accessible to the personnel undertaking the exchange; the coin containers of the various cash collecting mechanisms can be emptied only at a central location.

BRIEF DESCRIPTION OF THE DRAWINGS

Two exemplified embodiments of the invention will be described in more detail hereinunder with reference to the accompanying drawings, in which.

DESCRIPTION OF THE PREFERRED EMBODIMENT

Figure 1:
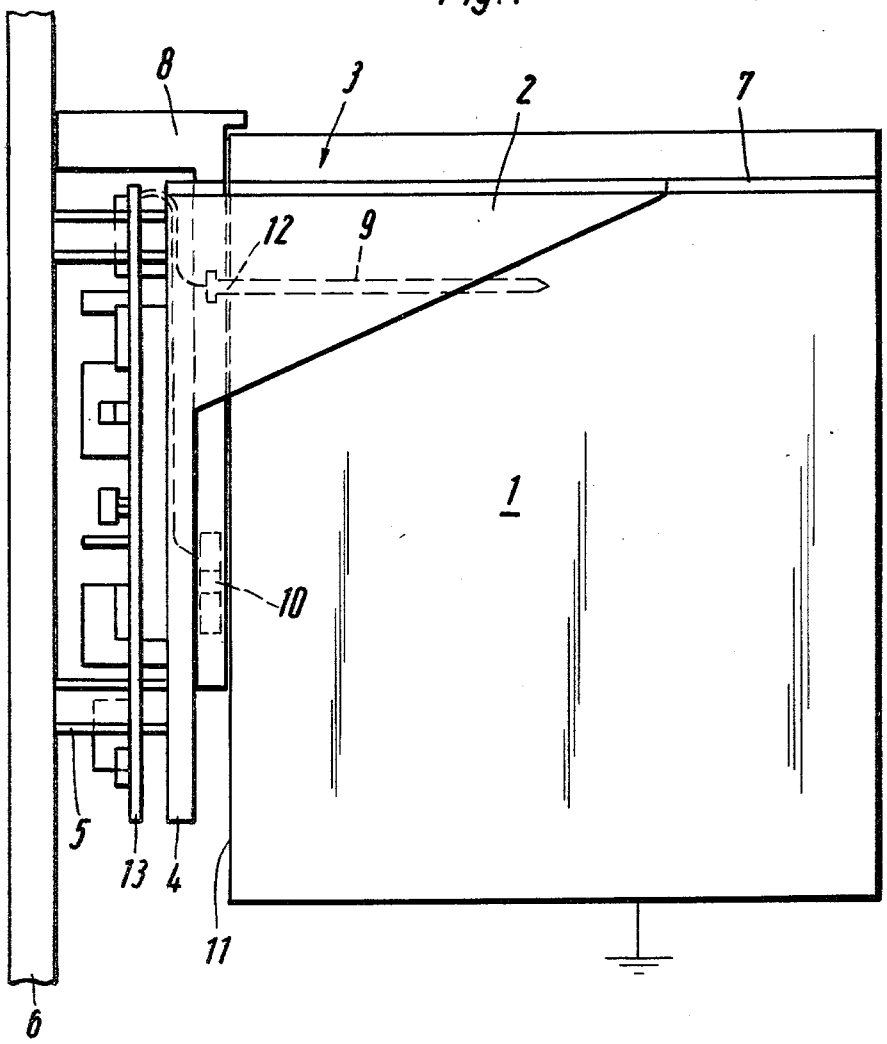
FIG. 1 is a side view of a coin collecting container and of a monitoring device for monitoring the fill level of the collected coins and the presence of the coin container.

The coin collecting container 1 forming, for instance, the receptacle or coin box of a pay telephone (not shown), vending machine, coin controlled table game, or the like, is pushed in FIG. 1 from the right between the two triangular plates 2 of a U-shaped cross-section member 3, the web or cross-piece 4 of which is fastened by means of four bolts 5 to the rear wall 6 of the housing of the coin collecting mechanism of the pay telephone or the like. In this respect, two rails 7 of the container 1 are guided in sliding engagement on the bent, upper edges of the plates 2. Fastened to that side of the web 4 which faces the container 1 is a plastics part 8 which has a portion offset toward the housing wall 6. Into the part 8 are pressed a metallic contact pin 9 and coil 10. The container rear wall 11 butts against the part 8 and has a hole 12 through which the contact pin 9 projects into the upper part of the container 1. The contact pin 9 in this respect does not touch the hole edge or is insulated from the container wall 11 by means of an insulating sleeve. The coil 10 is pressed or imbedded, from the side remote from the container 1, so deeply into the part 8 that its field is influenced by the container rear wall 11, as described later in this specification. On that side of the part 8 which faces the container 1 the position of the coil 10 is not perceptible, so that the operator exchanging the container has no clues as to where or if the presence of the container 1 is monitored.

Figure 2:
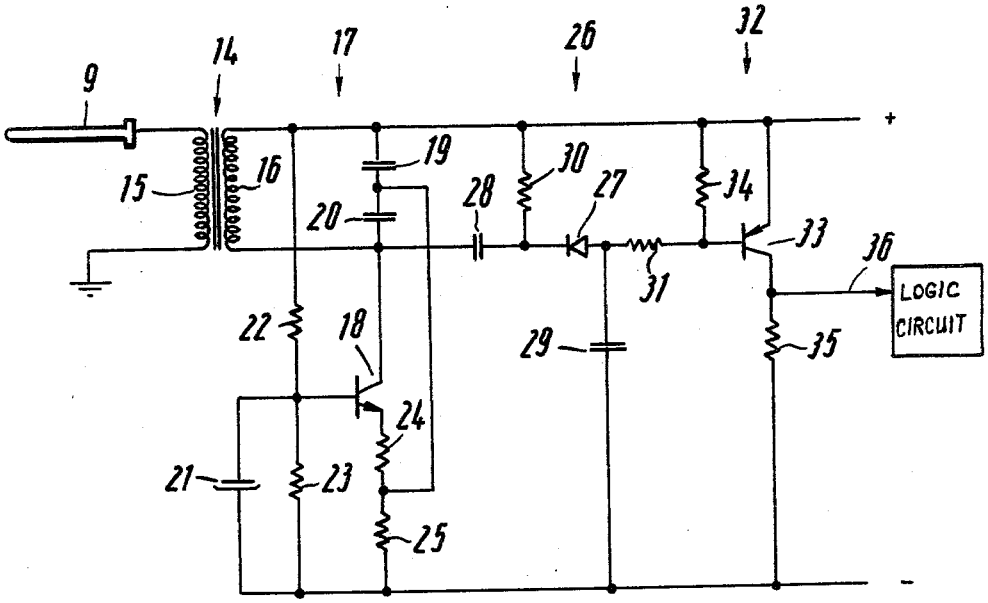
FIG. 2 is an electrical schematic diagram of that part of the device which monitors the fill level of the coin container.
Figure 3:
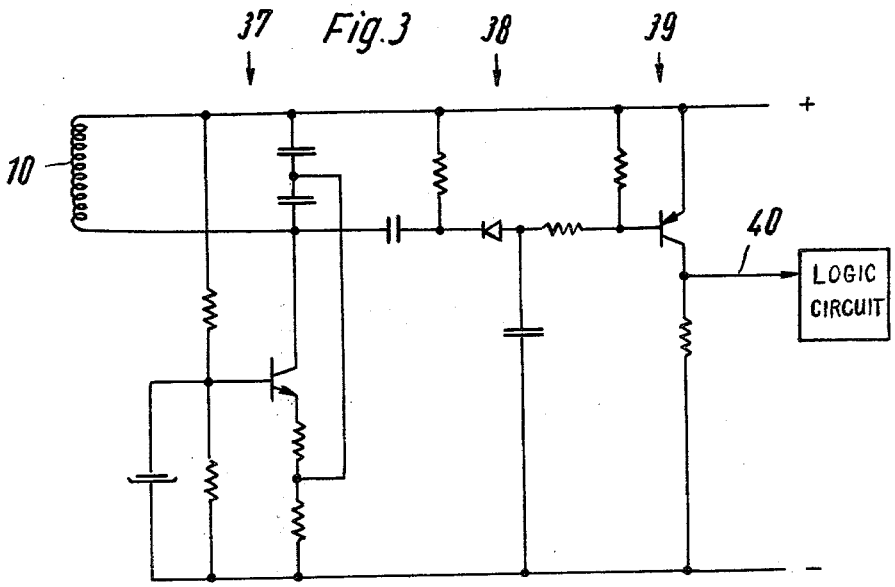
FIG. 3 is an electrical schematic wiring diagram of that part of the device which monitors the presence of the coin container in place on the cash collecting mechanism.

A printed circuit board 13 carries the electrical circuit shown in the schematic diagram of FIG. 2, connected to the contact pin 9, for monitoring the fill state or the desired upper lever of the coins collected in the container 1, and also carries the electrical circuit shown in the schematic diagram of FIG. 3, connected to the coil 10, for monitoring the presence of the container 1.

The circuit shown in FIG. 2 has a transformer 14 (386 3060). The one end of the transformer secondary winding 15 (110 turns) is connected to the contact pin 9; the other end is connected, together with the container 1, to ground. The transformer primary winding 16 (685 turns) forms the inductance of a transistor-oscillator circuit 17. The transformation ratio of the transformer 14 is 6.2, the transformed resistance at the low-ohmic side (winding 16) thus amounts to about one fortieth of the resistance at the high-ohmic side (winding 15) of the transformer. The oscillator 17 consists of a transistor 18 (2N2222), three capacitors 19, 20 and 21 (100 nF, 10 nF and 1 μF) and four resistors 22, 23, 24 and 25 (15 kOhm, 4.7 kOhm, 270 Ohm and 680 Ohm). Connected to the output of the oscillator 17 is a demodulation and integration stage 26 including a diode 27 (1N4148), two capacitors 28, 29 (each 10 nF) and two resistors 30, 31 (220 kOhm, 100 kOhm). The output of the demodulation and integration stage 26 is connected to an amplifier stage 32, which comprises a transistor 33 (2N2907) and two resistors 34 and 35 (each 47 kOhm). The output 36 of the amplifier stage 32 is connected to a microprocessor (not shown) of the pay telephone coin box.

The circuit shown in FIG. 3 corresponds to the electrical circuit in accordance with FIG. 2, except that the transformer 14 is abolished and instead of the transformer winding 16 the coil 10 is substituted and forms the inductance of the oscillator circuit 37. The remaining circuit elements of the oscillator 37, the demodulation and integration stage 38 and the amplifier 39 correspond also parameterwise to those of the corresponding circuit stages in accordance with FIG. 2, and for this reason the corresponding reference numerals for the circuit elements have been omitted from FIG. 3. The output 40 of the amplifier 39 is also connected to the microprocessor (not shown).

In the case of the described circuits in FIGS. 2 and 3, with the circuit elements or components with the approximate parameters as indicated in brackets, both oscillators 17 and 37 oscillate when no container is inserted. A respective D.C. signal is then present at both outputs 36 and 40.

When the container 1 is inserted into the pay telephone coin box in accordance with FIG. 1, then its rear wall 11 lies in the field of the coil 10 and the vibrations or oscillations of the oscillator 37 are suspended on account of the eddy-current losses in the wall 11. In this way, the signal at the output 40 disappears.

When the container 1 is filled with coins from the coin collecting mechanism up to the level at which the contact pin 9 is positioned, the ends of the transformer winding 15 are connected in circuit together by way of the coins in the container between the contact pin 9 and the grounded container 1. The resistance formed by the coins is transformed by the transformer 14 and the transformed resistance dampens or attenuates the oscillator vibrations or oscillations, so that these are suspended. In this respect, the D.C. signal at the output 36 disappears.

The prepayment telephone coin box is ready for operation when the output 36 emits a D.C. signal, but the output 40 emits no signal, to the microprocessor. In the other cases, in other words, upon the suspension of the D.C. signal at the output 36 and upon the occurrence of a D.C. signal at the output 40, the microprocessor blocks, by means of a logic circuit fed by these signals, the coin acceptance of the telephone and gives a signal which is associated with the respective case (container filled with coins or no container inserted) by way of the subscriber line to the telephone exchange, so that this can cause the container to be exchanged.

Figure 4:
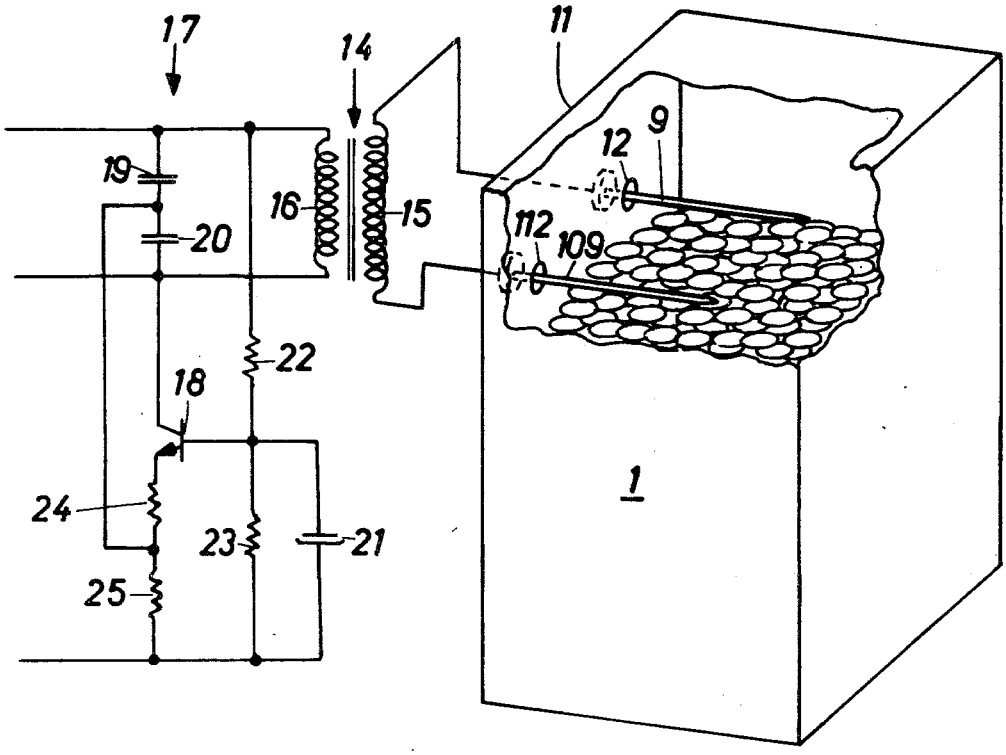
FIG. 4 is a schematic perspective elevation of a coin collecting container and of another fill level monitoring device having two contact members and an electrical schematic wiring diagram of a part of the device coupled to the two contact members.

In the case of the embodiment shown in FIG. 4 the monitoring device comprises two separate contact pins 9, 109, which project through holes 12, 112, provided in the container rear wall, into the upper part of the container 1. The contact pins 9, 109 do not touch the hold edge or are insulated from the rear container wall 11 by means of insulating sleeves. The spacing of the two contact pins 9, 109 is greater than the diameter of the coins that are to be collected, so that not a single coin can produce a connection between the two contact pins. The contact pin 9 is connected to the one end and the contact pin 109 to the other end of the winding 15 of the transformer 14. The circuit, to which the two contact pins 9, 109 are inductively coupled by the transformer 14 is identical with the circuit shown in FIG. 2. In FIG. 4 the coil 10 is not visible but of course it is also provided as well as the circuit shown in FIG. 3 and the logic circuit.

The contact pin 9 and the container 1 in FIG. 1 or the two contact pins 9, 109 in FIG. 4 can be connected, instead of inductively, also capacitively by one capacitor each, to the oscillator. The inductive coupling by means of the transformer 14 is, however, advantageous insofar as, as already mentioned, even severely contaminated coins bring about a suspension of the oscillator oscillations, which is reliably achievable in a more difficult manner with a capacitive coupling.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A monitoring device for the coin container of a coin collecting mechanism, comprising a coin container which is metallic and is exchangeable, contact means (1, 9), between which the coins collected in the container (1) are adapted to establish a connection at a specific filling height, a first oscillator circuit (17), coupling means (14) coupling said contact means (1, 9) in such a way to said first oscillator circuit (17) that the latter (17) is oscillating or not oscillating depending on whether the contact means (1, 9) are connected in circuit by the coins, a first signal circuit (26, 32) connected to said first oscillator circuit to emit a first signal which indicates whether the first oscillator circuit (17) is oscillating and accordingly whether the contact means (1, 9) are connected by the coins, a second oscillator circuit (37), a self-induction coil (10) connected to said second oscillator circuit (37), said coil (10) so arranged that one of the walls (11) of the coin container (1) is adapted to extend through the coil field and to influence the coil field in such a way that said second oscillator circuit (37) is oscillating or not oscillating depending on whether the coin container (1) is present, a second signal circuit (38, 39) connected to said second oscillator circuit to emit a second signal which indicates whether the second oscillator or circuit (37) is oscillating and accordingly whether the coin container (1) is present, and a logic circuit, to which said first and second signals from said first and said second signal circuit (26, 32; 38, 39) are fed and which emits a signal blocking the coin collecting mechanism when the first signal indicates that the contact means (1, 9) are connected by the coins or the second signal indicates that the coin container (1) is not present.

2. A device as set forth in claim 1, in which said first signal circuit (26,32) includes a demodulation and integration circuit stage (26) which is connected to said first oscillator circuit (17), and an output stage (32) connected to said demodulation and integration circuit stage and which amplifies the D.C. signal which is obtained by the demodulation and integration circuit stage.

3. A device as set forth in claim 1, in which said first signal circuit (26,32) and said second signal circuit (38,39) connected to the two oscillator circuits (17,37) are identical in construction.

4. A device as set forth in claim 1, in which said coupling means comprises a transformer (14) having at least two windings, said contact means (1,9) are connected to the opposite ends of one (15) of the two windings of said transformer (14), and the other winding (16) of said two windings forming part of the first oscillator circuit (17).

5. A device as set forth in claim 4, in which the transformation ratio of said transformer (14) is so great that this transforms the ohmic resistance at the one winding (15), which is adapted to be formed by the coins which connect the contact means (1,9), to a fraction, so that the transformed resistance brings about an attenuation of the first oscillator circuit (17) sufficient for the suspension of the oscillations therefrom even when the coins are highly contaminated and therefor, form a large resistance.

6. A device as set forth in claim 4, in which one end of the one transformer winding (15) is connected to the metallic coin container (1) which forms one of two contact means (1,9), a contact member (9) which projects into the upper part of the coin container (1) and which is insulated from the coin container, and the other end of said one transformer winding (15) connected to said contact member (9).

7. A monitoring device for the coin container of a coin collecting mechanism, comprising a coin container (1), two separate contact members (9, 109), which project into said container (1), the spacing of the two contact members (9, 109) which are isolated from one another being greater than the diameter of the coins that are to be collected and at least one of the two contact members being arranged in the upper part of the container (1) at a specific filling height, so that the coins collected in the container (1) establish a connection at said specific filling height between said two contact members (9, 109), an oscillator circuit (17), a transformer (14) having at least two windings (15,16), said contact members (9, 109) being connected to the opposite ends of one (15) of the two windings of said transformer (14), and the other winding (16) of said two windings forming part of the oscillator circuit (17) in such a way that the oscillations thereof are suspended when said two contact members (9, 109) are connected in circuit by the coins, and a signal circuit (26, 32) connected to said oscillator circuit (17) to emit a signal which indicates whether the oscillator (17) is oscillating.

8. A device as set forth in claim 7, in which the transformation ratio of said transformer (14) is so great that this transforms the ohmic resistance at the one winding (15), which is adapted to be formed by the coins which connect said two contact members (9, 109) to a fraction, so that the transformed resistance brings about an attenuation of the oscillator circuit (17) sufficient for the suspension of the oscillations therefrom even when the coins are highly contaminated and therefor, form a large resistance.

9. A device as set forth in claim 7, in which said signal circuit (26, 32) includes a demodulation and integration circuit stage (26) which is connected to said oscillator circuit (17), and an output stage (32) connected to said demodulation and integration circuit stage and which amplifies the D.C. signal which is obtained by the demodulation and integration circuit stage.

10. A monitoring device for the coin container of a coin collecting mechanism, comprising a coin container which is metallic and is exchangeable, an oscillator circuit (37), a self-induction coil (10) connected to said oscillator circuit (37), said coil (10) so arranged that one of the walls (11) of the coin container (1) is adapted to extend through the coil field and to influence the coil field in such a way that said oscillator circuit (37) is oscillating or not oscillating depending on whether the coin container (1) is present, a signal circuit (38, 39, 40) connected to said oscillator circuit (37), which emits a signal blocking the coin collecting mechanism when the coin container (1) is not present.

11. A monitoring device for the coin container of a coin collecting mechanism, comprising a coin container (1) which is exchangeable, first detection means (1, 9, 17) having contact means (1, 9), between which the coins collected in the container (1) are adapted to establish a connection at a specific filling height, a first signal circuit (26, 32) connected to said first detection means (1, 9, 17) to emit a first signal which indicates whether the contact means (1, 9) are connected by the coins or not, second detection means (10, 37) having sensing means (10) so arranged that one of the walls (11) of the coin container (1) is adapted to influence said sensing means (10), a second signal circuit (38, 39) connected to said second detection means (10, 37) to emit a second signal which indicates whether the coin container (1) is present, and a logic circuit, to which said first and second signals from said first and said second signal circuit (26, 32; 38, 39) are fed and which emits a signal bolcking the coin collecting mechanism when the first signal indicates that the contact means (1, 9) are connected by the coins or the second signal indicates that the coin container (1) is not present.

* * * * *